United States Patent [19]

Klawitter

[11] Patent Number: 4,479,328

[45] Date of Patent: Oct. 30, 1984

[54] PUSH-PULL TOY WITH VANE MEMBERS ROTATING IN DIFFERING ROTATIONAL RELATIONSHIP

[75] Inventor: Ronald R. Klawitter, Hermann, Mo.

[73] Assignee: Handi-Pac, Inc., Hermann, Mo.

[21] Appl. No.: 423,699

[22] Filed: Sep. 27, 1982

[51] Int. Cl.[3] ..... A63H 33/00

[52] U.S. Cl. ..... 446/237; 446/448

[58] Field of Search ..... 46/204, 205, 39, 14, 46/201, 202; 15/145

[56] References Cited

U.S. PATENT DOCUMENTS

| | | | |
|---|---|---|---|
| 420,709 | 2/1890 | Wallace | 46/205 |
| 1,235,455 | 7/1917 | Foans | 46/205 |
| 1,572,141 | 2/1926 | Hildebrandt et al. | 46/221 |
| 2,781,609 | 2/1957 | Allen | 46/39 |
| 3,187,461 | 6/1965 | Vicini | 46/205 |
| 3,292,300 | 12/1966 | Lescher et al. | 46/205 |
| 3,328,824 | 7/1967 | Chalfant | 15/145 |
| 4,083,143 | 4/1978 | Allen | 46/204 |

*Primary Examiner*—Robert A. Hafer
*Assistant Examiner*—William H. Honaker
*Attorney, Agent, or Firm*—Polster, Polster and Lucchesi

[57] ABSTRACT

A push-pull toy assembly wherein paired rotating vane members of the assembly are driven at differing rotational relationship through a gear mechanism connected to the wheels of the assembly.

11 Claims, 7 Drawing Figures

PUSH-PULL TOY WITH VANE MEMBERS ROTATING IN DIFFERING ROTATIONAL RELATIONSHIP

BACKGROUND OF THE INVENTION

The present invention relates to a toy assembly and more particularly to a push-pull type toy assembly including a pair of spaced rotating vane members which are driven in differing rotational relationship to create a visibly distinctive moving pattern.

Push-pull type toy assemblies which incorporate rotating members to create decorative patterns have long been known in the toy arts to provide attractive and educational arrangements appealing to the visual and manual interests of children of all ages.

The present invention provides such a novel toy assembly which can be readily and economically manufactured and assembled with a minimum of parts and effort into an attractive toy arrangement that is light in weight, hand manipulatable by a small child with a minimum of effort and skill, eliminating batteries or other sources of more complex and expensive energy production, and yet, at the same time, providing visual attractiveness and permitting the use and exercise of basic, manipulative skills of even very young children.

More particularly, the present invention provides a push-pull toy comprising a housing member, a support means fixed to and extending from the housing member; a pair of spaced vane members rotatably mounted on the support means, at least a portion of the vane members being disposed relative to the housing so as to be visible therefrom; wheel means rotatably supported to the housing; a propelling member for the housing; and a gear means connecting the wheel means to the vane members to cause the vane members to rotate in differing rotational relationship when the housing is placed into motion by the propelling member whereby the visible portion of the differing rotating vane members creates a visibly decorative pattern.

In addition, the present invention provides a novel, straight-forward, simple and yet efficient manner for connecting and disconnecting a propelling member to a toy assembly.

It is to be understood that various changes can be made in the arrangement, construction and form of the several parts of the apparatus disclosed herein without departing from the scope or spirit of the present invention. For example, the embodiment presented is in the form of a popular line type lawn trimmer but the rotational aspects of the vane members in the novel assembly could be adapted for use in such toy assemblies as helicopters, merry-go-rounds, sparklers, multi-legged insects or even toy game devices, with information printed on one wheel matching in random fashion with information on the other when rotation ceases.

BRIEF DESCRIPTION OF THE DRAWINGS

Referring now to the drawings.

DESCRIPTION OF THE PREFERRED EMBODIMENT

Figure 1:
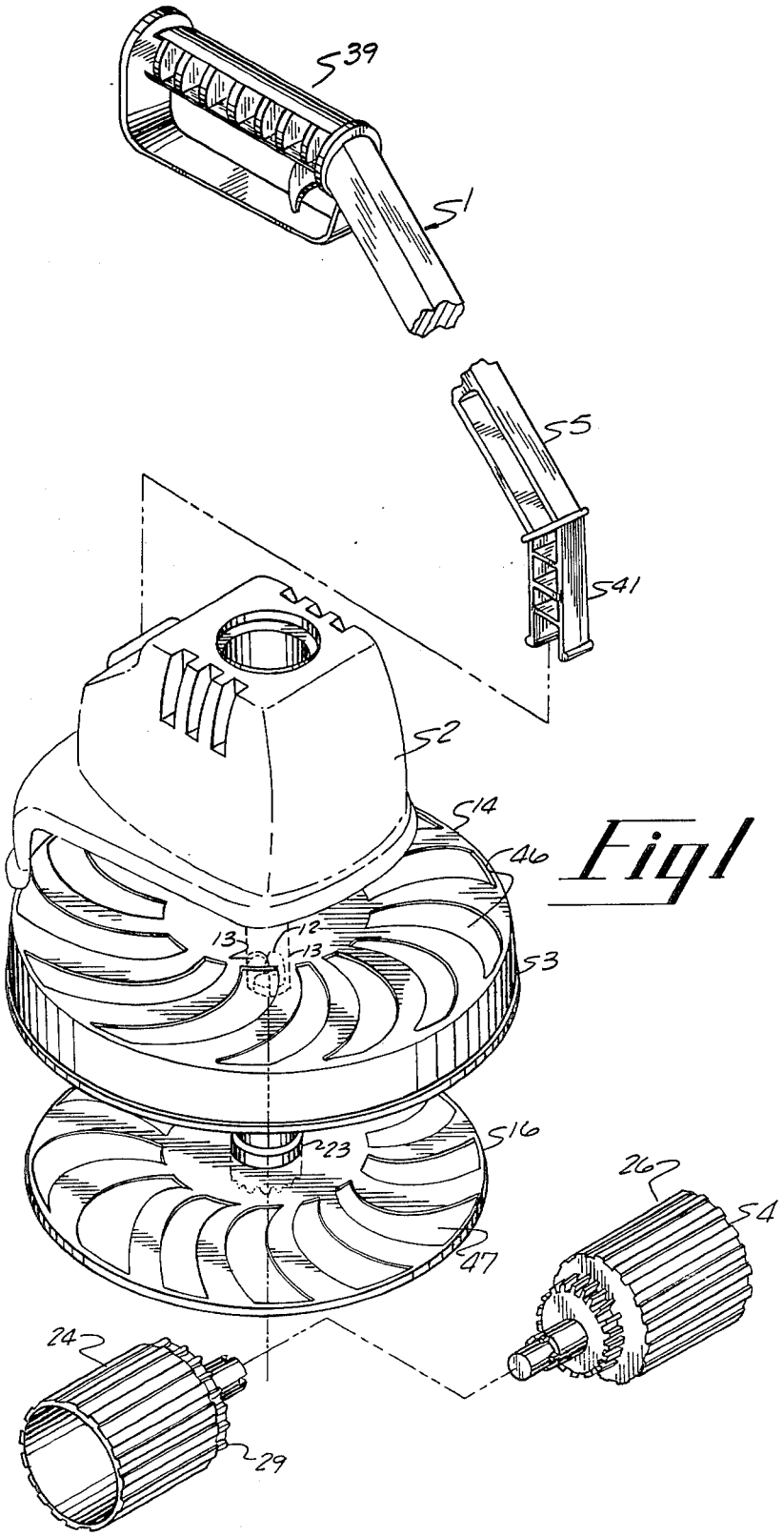
FIG. 1 is an isometric exploded view of an overall toy assembly in the form of a toy trommer which incorporates the novel features of the present invention.

As can be seen in FIG. 1 of the drawings, the overall assembly embodying the present invention is in the form of a lawn trimmer 1, including simulated motor housing 2, rotatable vane member assembly 3, wheel assembly 4 and propelling member 5. It is to be understood that the overall assembly can be made from any one of a number suitable materials or combinations thereof and, in the instant embodiment, advantageously can be formed in several parts from molded plastic, at least a portion of which parts are yieldable or flexible for reasons set forth hereinafter.

Figure 2:
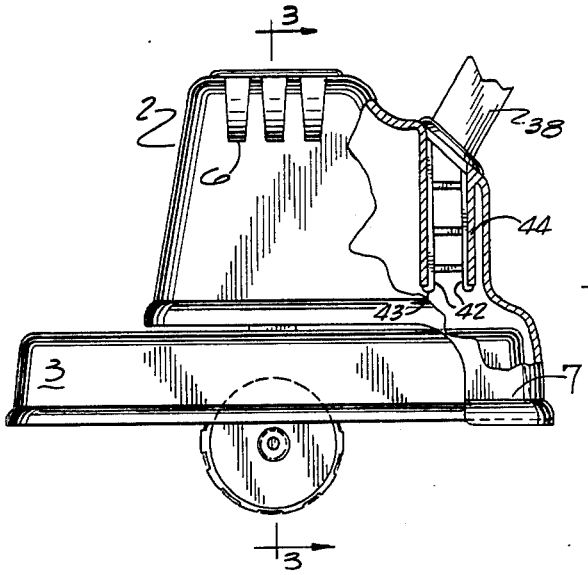
FIG. 2 is a partially broken away side view of the apparatus of FIG. 1.
Figure 3:
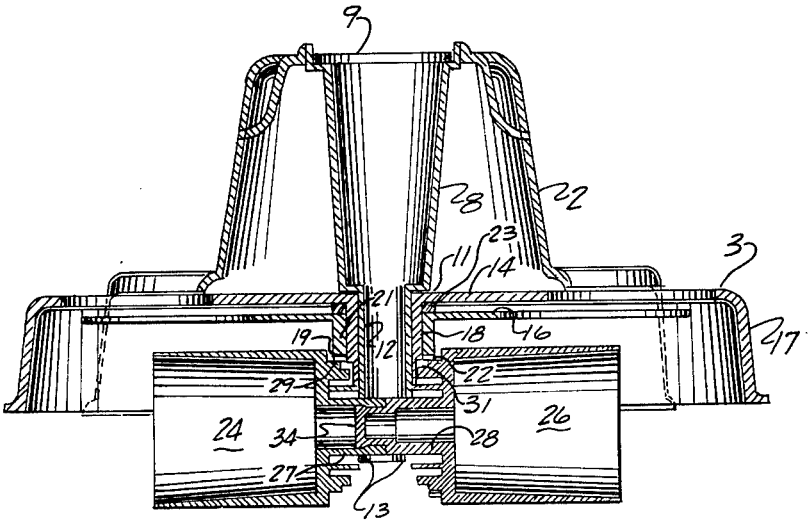
FIG. 3 is a cross-sectional view of the housing assembly of FIG. 2 taken in a plane passing through line 3—3 of FIG. 2.
Figure 4:
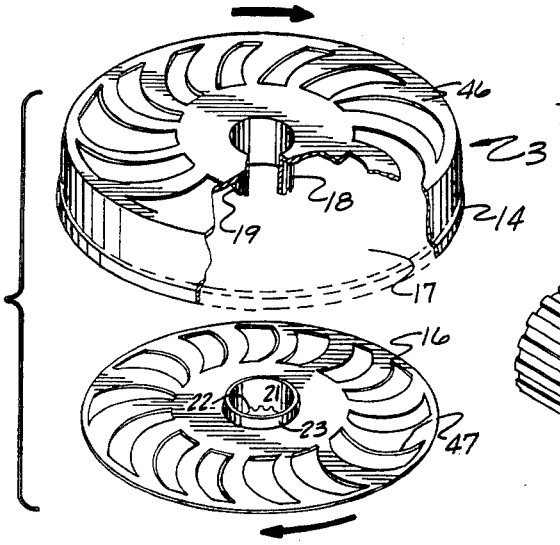
FIG. 4 is an isometric exploded view of the pair of rotatable vane members disclosing in detail a portion of the integral and inter-fitting gear mechanism.

As can be seen in FIGS. 2 and 3, housing 2 is provided with shaped flutes 6 at the top portion thereof of give an apperance of a trimmer motor casing. The lower rear portion only of housing 2 is shaped to extend down beyond vane members 3 to provide the appearance of an apron guard 7. Housing 2 is hollow in shape to include internal support column member 8, which is fixed to and extends vertically downward from the roof of housing 2. Since support member 8 is also hollow in the embodiment disclosed, a suitable label 9 can be provided to cover the opening at the top of the hollow column.

Referring particularly to FIG. 3, it can be seen that support column member 8 is stepped or recessed at 11 to provide a lower stub portion 12, which serves as the axle upon which vane member assembly 3 is rotatably mounted in horizontal fashion. The lower end of stub portion 12 is, in turn, provided with aligned horizontal apertures 13, sized to permit the axle of the wheel assembly 4 to pass therethrough in rotatably supported fashion in a manner described hereinafter. It is to be noted that step 11 is positioned slightly below a substantial portion of the lower edge of housing 2 to provide a shoulder against which vane member assembly 3 abuts when rotatably mounted on stub 12.

Vane assembly 3 which is sized to extend in horizontal fashion beyond the lower edge of housing 2 for visual observation thereof, includes a pair of upper and lower vane members 14 and 16, respectively, each being shown in the embodiment disclosed as of circular disc-shape with the disc 14 being of larger diameter than the disc 16 and having a peripheral apron guard 17 extending downwardly from the edge thereof to nestingly receive disc 16 therein, when rotatably mounted on stub 12. Disc 14 has a centrally disposed mounting sleeve 18 of sufficient diameter to rotatingly engage on stub axle 12 of support member 8. The lower edge of sleeve 18 incorporates a plurality of teeth thereabout to provide a gear 19 adapted to engage with and be driven by one of the gears on wheel assembly 4 in a manner described hereinafter. Disc 16 also has a centrally disposed mounting sleeve 21 which is of sufficient diameter to rotate on mounting sleeve 18 of the upper vane member 14.

Sleeve 21 is shorter in length than sleeve 18 so as not to cover gear 19, and it, too, is provided at its lower edge with a plurality of teeth thereabout to provide gear 22 adapted to engage with and be driven by the other of the gears on wheel assembly 4 to permit counter-rotation of vane members 14 and 16, all as described hereinafter. It is to be noted that a suitable centrally disposed spacer ring 23 is provided on the upper face of vane member 16 to hold the vane members is spaced relationship during counter-rotation.

Figure 5:
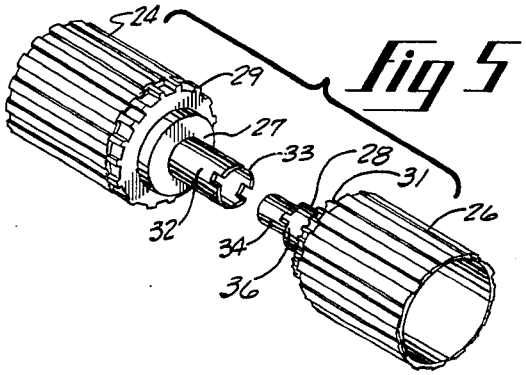
FIG. 5 is an isometric exploded view of the pair of wheel member disclosing in detail the other portion of the integral gear mechanism which meshes with the gear on the vane members of FIG. 4.

Referring to FIGS. 3 and 5, wheel assembly 4 includes a pair of spaced, opposed wheels 24 and 26. Each wheel is provided with a stub portion 27 and 28, respectively, extending from one side thereof in stepped, concentric fashion. Wheel 24 is provided adjacent its stub 27 with a plurality of teeth thereabout, to provide vertically extending gear 29, sized and positioned to engage gear 19 of upper vane 14 in meshing fashion, and wheel 26 is provided adjacent its stub portion 28 with a plurality of teeth thereabout to provide vertically extending gear 31, sized and positioned to engage gear 21 of lower vane 16. Since the wheels 24 and 26 are positioned on opposite sides of support member 8, in the embodiment disclosed, the vane members 14 and 16 are thus driven by the gear system in counter-rotating fashion when the wheels are moved along a surface in the same direction by propelling member 5 attached to housing 2. As can be seen in FIG. 5, the stub portion 27 of wheel 24 ends in female sleeve 32 having splined edges 33. The stub portion 28 of wheel 26 ends is male shaft 34 which is sized and shaped to snugly nest in female sleeve 32, splines 36 being provided at the opposite end of shaft 34 to engage the splined edges 33 of sleeve 32 and rotationally lock the nesting male-female members in place to form axle 37. As can be seen in FIG. 3, axle 37 is sized to pass through stub apertures 13, located at the lower end of support member 8, so that the wheel assembly and drive gears are rotatively supported thereby with the drive gears 29 and 31 meshing respectively with driven gears 19 and 22.

Figure 6:
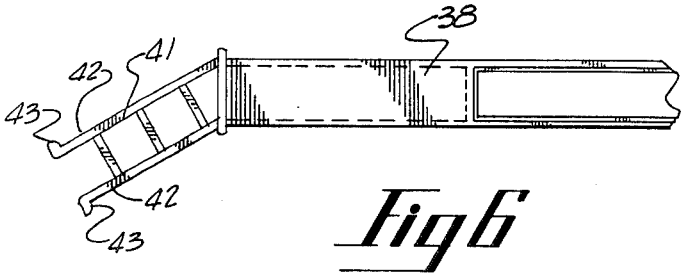
FIG. 6 is a side view of a portion of the novel propelling member of the assembly of FIGS. 1–5.
Figure 7:
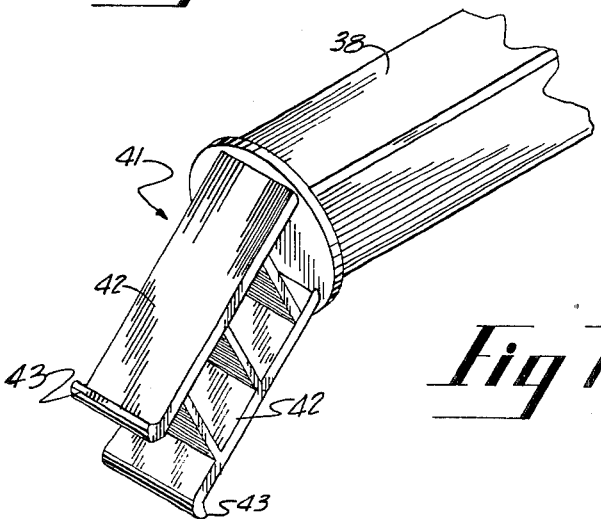
FIG. 7 is an enlarged isometric view of a portion of the propelling member of FIG. 6.

The novel propelling member 5 of the present invention is disclosed in FIGS. 6 and 7 of the drawings as including a substantially rigid longitudinally extending rod member 38, which also can be made of plastic molded material. One end of rod member 38 is shaped to provide a simulated trigger-grip handle 39. The other end of rod member 38 is offset at an angle to provide the male portion 41 of a propelling member lock arrangement. This male portion 41 is formed to include a pair of spaced opposed yieldable leaves 42, having opposed outwardly protruding shoulders or locking edges 43 at the extremities thereof. The male portion 41 is contoured to extend into female sleeve 44 formed in housing 2, advantageously above the center line of apron guard 7, to extend vertically downward within the housing. Sleeve 44 is sized and shaped to snugly receive yieldable sleeve 42 to cooperate with edges 43 to lock the propelling member 5 into position. It is finally to be noted that the discs of vane members 14 and 16 are each provided along their periphery with sets of spaced, radially extending teardrop-like apertures 46 and 47, with the apertures of one set sloping in a direction opposite that of the apertures of the other set to create an attractive criss-cross visual pattern when the vane member 14 and 16 are placed into counter-rotating motion.

It is to be understood that various changes can be made by one skilled in the art in the several parts of the novel apparatus disclosed without departing from the scope or spirit of the present invention. for example, the vane members could be disposed in the vertical position within or outside the housing and the housing contoured and apertured in different shapes and forms. The vanes can be provided with skirts extending to a position close to the ground, with curved slots in the skirts from and through the lower edges of the skirts, to simulate legs of an insect, the housing being made in the form of the body of the insect. The propelling means can take the form of a short, U-shaped bar-type handle. Further, the wheel, gear and vane means could be sized and assembled to provide other differing rotational movements and the apertures varied to provide other patterns.

I claim:

1. A push-pull toy comprising a housing member, support means fixed to and extending from said housing; a pair of spaced parallel facing substantially similarly sized vane members rotatably mounted on said support means, at least a portion of said vane members disposed relative to said housing so as to be visible therefrom with aperture means in at least one of said vane members to permit visual discernment therethrough of the rotational movement of the other; wheel means rotatably supported to said housing; a propelling member for said housing; and gear means connecting said wheel means to each of said vane members to cause said vane members to rotate in differing rotational relationship when said housing is placed into motion by said propelling member whereby the visible portion of said differing rotating vane members creates a visibly decorative pattern.

2. The apparatus of claim 1 wherein said propelling member comprises a longitudinally extending rod member, one end of which provides a manual grip device and the other end of which provides one portion of a nesting male-female lock arrangement, the other portion of said nesting male-female lock arrangement being fixed to said housing, said male portion of said lock arrangement includes a pair of spaced opposed parallel yieldable leaves extending in cantilever fashion from opposite sides of the extremity thereof and having protruding locking edges extending normally outwardly from said opposite sides of said extremity, said female portion of said lock arrangement including a sleeve having opposed open ends, sized and shaped to snugly receive said yieldable leaves of said male portion and to cooperate with the outwardly protruding edges of said leaves to press said edges inwardly as they pass through said sleeve from one end to the other of said sleeve to spring open upon passing therethrough to lock said male portion therein against the end of said sleeve.

3. The apparatus of claim 1, wherein said gear means connect said wheel to said vane members on opposite sides of said support means to cause said vane members to rotate in counter-rotational relationship when said housing is placed into motion.

4. The apparatus of claim 1 wherein said pair of spaced parallel vane members comprise first and second disc members and said aperture means includes a plurality of spaced apertures radially disposed along the periphery thereof whereby a decorative motion pattern is created upon the differing rotational relationship of said disc members.

5. The apparatus of claim 1 wherein said wheel means includes a pair of spaced opposed wheels, each having a stub portion extending concentrically from one side thereof, the stub portion of one wheel forming a splined male member and the stub portion of the other wheel forming a splined sleeve female portion, said stub portions being sized to lockingly nest to provide an axle rotatably mouned on said support means.

6. The apparatus of claim 1 wherein said support means comprises a vertical shaft extending therefrom, said spaced vane members being disposed in a horizontal position thereon; said gear means including two sets of meshing gear pairs and said wheel means including one pair of space opposed wheels, the pair of gears of one meshing gear set being respectively connected to one of said wheels and one of said rotating vane members and the pair of gears of the other meshing gear set being connected to the other of said wheels and the other of said rotating vane members whereby said vane members are placed in counter-rotational relationship when said housing is placed into motion by said propelling member.

7. The apparatus of claim 1 wherein said gear means includes gear members mounted on said vane members in concentric and rotatable fashion relative each other, and gear members mounted on said wheel means to mesh with said gears on said vane members to drive said vane members.

8. The apparatus of claim 1 wherein said spaced vane members comprise first and second disc members having a plurality of spaced apertures radially disposed along the periphery thereof whereby a decorative motion pattern is created upon the counter-rotational relationship therebetween.

9. The apparatus of claim 8 wherein one of said disc members is cup-shaped to provide a rim and to nestingly receive the other of said disc members, the periphery of said other disc member being in spaced annular relationship to the inner wall of said rim.

10. A molded plastic push-pull toy comprising a housing having a shaft member integral therewith, extending vertically downward within said housing in spaced relationship to the inner walls of said housing with a step-down portion extending beyond said inner wall housing; a pair of upper and lower molded plastic vane members rotatably mounted in spaced parallel horizontal relationship on the step-down portion of said vertical shaft member, the upper vane member being of disc shape and having a peripheral rim to provide a cup to receive the lower vane member, also of disc shape, in nesting relationship therewith; each vane member having a plurality of spaced apertures disposed along the periphery thereof to permit visual discernment of the rotational movement of the other with the apertures of one vane member sloping in a direction opposite the apertures of the other vane member; each vane member further having one of two sets of meshing gears molded integrally therewith and sized so that the gear of the lower vane member rotates concentrically about the gear of the upper vane member which is sized to rotate about the step-down portion of the vertical shaft, the discs of the vane members being sized to extend beyond at least a substantial portion of the lower edge of the housing whereby a decorative motion pattern can be visually created by the spaced apertures of each disc when rotated; the lower end of said vertical shaft having a horizontal aperture disposed therein; a pair of spaced opposed molded plastic wheels, each having a stub portion extending integrally therewith in concentric fashion from one side thereof, the stub portion of one wheel forming a splined male member and the stub portion of the other wheel forming a splined sleeve female portion, said stub portions being sized to lockingly nest to provide an axle rotatably mounted in the horizontal aperture of said vertical shaft, each wheel further having the other of two sets of meshing gears molded integrally therewith and sized and positioned so that the gear of one wheel meshes with the gear of the upper vane and the gear of the other wheel meshes with the gear of the lower vane; and a propelling member for said housing whereby the visible portion of said apertures in said discs are counter-rotated with the motion of said wheels to create a visibly decorative pattern.

11. The apparatus of claim 10 wherein said propelling member comprises a molded plastic longitudinally extending rod member, one end of which is formed in a handle shape to provide a manual grip and the other end of which is formed to provide one portion of a nesting male-female lock arrangement, the other portion of said female lock arrangement being fixed to said housing, said male portion of said lock arrangement including a pair of spaced opposed parallel integrally molded yieldable leaves extending in a cantilever fashion from opposite sides of the extremity thereof and having protruding locking edges extending normally outwardly from said opposite sides of said extremity, said female portion of said lock arrangement including a molded sleeve integrally disposed in said mower housing with opposed open ends and sized and shaped to snuggly receive said yieldable leaves of said male portion and cooperate with the outwardly protruding edges of said leaves to press said edges inwardly as they pass through said sleeve from one end to the other of said sleeve to spring open upon passing therethrough to lock said male portion therein against the end of said sleeve.

* * * * *

UNITED STATES PATENT AND TRADEMARK OFFICE

CERTIFICATE OF CORRECTION

PATENT NO. : 4,479,328

DATED : October 30, 1984

INVENTOR(S) : Ronald R. Klawitter

It is certified that error appears in the above—identified patent and that said Letters Patent is hereby corrected as shown below:

Column 2, line 7, "gear" should be --gears--;

Column 4, line 54, "wheel" should be --wheel means--.

Signed and Sealed this

*Sixteenth* Day of *April 1985*

[SEAL]

*Attest:*

DONALD J. QUIGG

*Attesting Officer* *Acting Commissioner of Patents and Trademarks*